US005130504A

United States Patent [19]

Moldovan et al.

[11] Patent Number: 5,130,504

[45] Date of Patent: Jul. 14, 1992

[54] BI-DIRECTIONAL DIRECT CURRENT SWITCHING APPARATUS HAVING BIFURCATED ARC RUNNERS EXTENDING INTO SEPARATE ARC EXTINGUISHING CHAMBERS

[75] Inventors: Peter K. Moldovan, Cascade; Peter J. Theisen, West Bend; Mark A. Juds, New Berlin; Robert A. Kihn, Menomonee Falls, all of Wis.

[73] Assignee: Eaton Corporation, Cleveland, Ohio

[21] Appl. No.: 574,702

[22] Filed: Aug. 29, 1990

[51] Int. Cl.[5] ..... H01H 33/04; H01H 33/18

[52] U.S. Cl. ..... 200/147 R; 200/117 A; 200/147 B

[58] Field of Search ..... 200/147 A, 147 B, 147 R

[56] References Cited

U.S. PATENT DOCUMENTS

| | | | |
|---|---|---|---|
| 2,356,040 | 7/1942 | Ellis et al. | 200/147 |
| 2,506,991 | 5/1950 | Brown | 200/147 |
| 2,945,109 | 7/1960 | Fehling | 200/147 |
| 3,090,854 | 5/1963 | Kretzschmar | 200/147 |
| 4,404,443 | 9/1983 | Coynel et al. | 200/147 A |

*Primary Examiner*—A. D. Pellinen
*Assistant Examiner*—D. Le
*Attorney, Agent, or Firm*—L. G. Vande Zande

[57] ABSTRACT

Direct current switching apparatus having front and rear arc extinguishing chambers substantially coextensive, the rear chamber being separated into two laterally spaced arc extinguishing chambers, each arc extinguishing chamber comprising rows of non-magnetic parallel splitter plates, a pair of spaced conductors each having a stationary contact element spanning both the front and rear arc extinguishing chambers, power supply terminals connected to the respective spaced conductors, magnetic plates disposed in front of the front chamber and in back of the back chamber having magnetic means providing a magnetic path externally around the chambers, permanent magnets magnetically coupled to at least one of the magnetic plates providing a magnetic field across the respective chambers, a movable contact movable normal to a front to rear direction into and out of bridging engagement with the stationary contacts, and an electromagnetic drive motor disposed coextensive with said arc extinguishing chambers coupled at a lower end to the movable contact. Bifurcated arc runners of the conductors lead from the stationary contact elements into respective front and rear chambers, and a conductor surrounds the laterally spaced arc extinguishing chambers to cooperate with the respective arc runners therein. Arcs established between the stationary and movable contact elements are moved from the contacts into either the front or rear chambers by the magneteic field according to polarity of the power applied to the respective terminals. The electromagnetic motor is readily and inexpensively manufacatured and assembled by utilizing molded housing parts to position and retain elements of the motor. The apparatus is particularly well suited for high voltage, high current applications requiring lightweight, compact apparatus.

20 Claims, 8 Drawing Sheets

90
74
64
54
58
52
38
42
8
20
8b
18
58'
38d
88
42b
68f
68a
70
44
16
17
68e
80
68d
16c
16b
68b
16d
16a
80
38c
68c
68g 66f
66d
66h
66a
66e
66
66c
66g
66b

BI-DIRECTIONAL DIRECT CURRENT SWITCHING APPARATUS HAVING BIFURCATED ARC RUNNERS EXTENDING INTO SEPARATE ARC EXTINGUISHING CHAMBERS

CROSS REFERENCE TO RELATED APPLICATIONS

This invention is related to copending U.S. patent application Ser. No. 07/435,228, now U.S. Pat. No. 5,005,874, entitled Direct Current Switching Apparatus filed Nov. 12, 1989 in the names of Peter J. Theisen, Daniel A. Wycklendt, Mark A. Juds and Peter K. Moldovan. This application is also related to copending U.S. patent application entitled "Bi-directional Direct Current Switching Apparatus Having Arc Extinguishing Chambers Alternatively Used According to Polarity Applied to Said Apparatus" filed concurrently herewith in the names of Peter K. Moldovan, Mark A. Juds and Robert A. Kihn. Both of the above mentioned applications are assigned to the assignee of this application.

BACKGROUND OF THE INVENTION

This invention relates to apparatus for switching direct current (DC) electric power. More particularly it relates to apparatus of the aforementioned type which is non-polarized or bidirectional, i.e. its performance is independent of polarity of the current at the power terminals, and can switch high voltage DC power. Still more particularly, the invention is related to apparatus of the aforementioned type which is compact, lightweight, may be hermetically sealed and can switch high voltage DC power at high altitude.

High voltage DC power is one of the most efficient, reliable and lightweight methods to generate and distribute energy. Development of high torque samarium cobalt brushless DC motors has resulted in low weight alternatives to hydraulic actuators used in weight and reliability-sensitive applications, e.g. aircraft. However, difficulties in switching high voltage DC power, particularly at high altitude, and the weight and volume of conventional DC switching apparatus capable of quenching high voltage circuits at altitudes, preclude the use of such switching apparatus in aircraft. As a result, the inability to satisfactorily switch high voltage DC power at altitude has delayed use of this power in aircraft.

SUMMARY OF THE INVENTION

It is an object of this invention to provide improved DC switching apparatus.

It is a further object of this invention to provide DC switching apparatus capable of switching high voltage DC power.

It is a further object of this invention to provide DC switching apparatus which is non-polarized.

It is a further object of this invention to provide DC switching apparatus capable of switching high voltage DC power at high altitude.

It is still a further object of this invention to provide DC switching apparatus capable of switching high voltage DC power at high altitude, which apparatus is compact and lightweight.

It is still a further object of this invention to provide DC switching apparatus of the aforementioned type which is economically and efficiently manufactured.

This invention provides bi-directional DC switching apparatus comprising a front arc extinguishing chamber and a pair of laterally arranged rear arc extinguishing chambers disposed adjacent and substantially coextensive with the front chamber, a spaced pair of conductors traversing the respective front and rear chambers, each conductor having a stationary contact and an arc runner leading therefrom, the arc runner being bifurcated into front and rear arc runners extending into respective corresponding arc extinguishing chambers, conductive means cooperating with the respective rear arc runners providing divergent paths into the respective rear chambers, a movable contact and means driving said movable contact into and out of bridging engagement with said stationary contacts, movement of the bridging contact out of engagement with the stationary contacts establishing respective arcs therebetween, magnetic means providing a magnetic field across the arc chambers normal to the arcs, current in the arcs combining with the magnetic field to create forces assisting in movement of the arc along either the front or rear arc runners into the respective arc extinguishing chambers according to polarity of DC power connected to the conductors.

This invention further provides an electromagnetically operated linear motor for driving the movable contact, components of the motor being positioned within a particularly configured internal cavity of a molded housing, one portion of the housing being further configured for positioning a portion of the magnetic means and the front arc extinguishing chamber and providing guide means for the movable contact.

The foregoing and other features and advantages of this invention will become more readily apparent and understood when reading the following description and appended claims in conjunction with the accompanying drawings.

DETAILED DESCRIPTION OF THE PREFERRED EMBODIMENTS

Figure 1:
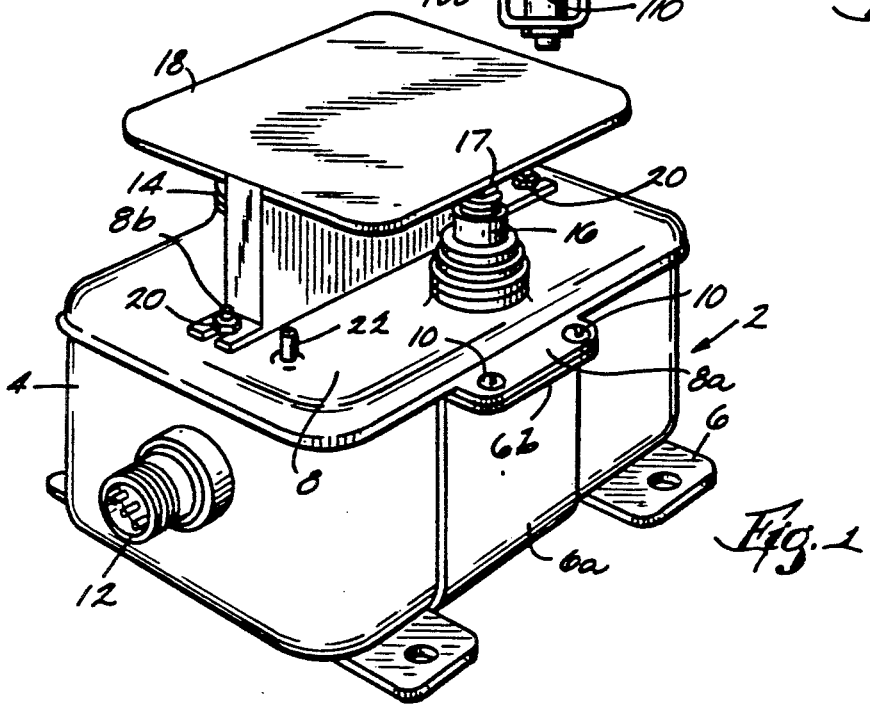
FIG. 1 is a perspective view of a hermetically sealed electromagnetic contactor comprising the bi-directional DC switching apparatus of this invention oriented, for purposes of the following description only, on its back side with a front side disposed upward and a multipin connector extending from a bottom side thereof.

With reference to FIG. 1 of the drawings, a hermetically sealed electromagnetic contactor 2 incorporating the bi-directional DC switching apparatus of this invention is shown in a perspective view. The contactor 2 comprises an outer metal envelope comprising a can 4 having a mounting plate 6 affixed to the back thereof by welding or the like and a header 8 hermetically welded over an open front side of can 4. Directional references herein, such as "front", "rear", "top", "bottom" and the like, are illustrative only for convenience and clarity in description, and are not to be construed as limitations to the scope of the invention defined in the appended claims. As a reference for the term "compact" as used herein, the envelope comprising can 4 and header 8 may be on the order of 3.42 inches wide by 5.00 inches long by 3.23 inches high. Header 8 has outwardly projecting flanges 8*a* extending from opposite lateral edges. Mounting plate 6 has forwardly extending straps 6*a* at opposite lateral sides, the free ends of which terminate in laterally projecting flanges 6*b* secured to flanges 8*a* by fasteners 10.

A multipin connector 12 is hermetically attached within an opening in a bottom wall of can 4 to provide connection to control electronics (not shown) for the bi-directional DC switching apparatus within the envelope. DC power terminals 14, 16 are attached and hermetically sealed to header 8, electrical insulated therefrom, to extend through the header. The externally projecting portions of terminals 14, 16 have tapped holes for receiving screws 17 which attach power supply conductors (not shown) to the terminals. A generally T-shaped insulating barrier 18 is attached to header 8 by a pair of nuts 20 which threadably engage threaded posts 8*b* welded to the exterior of header 8. Barrier 18 isolates the power terminals 14, 16 and the attached power supply conductors from each other and provides a protective cover thereover to reduce electrical shock hazard. Header 8 is also provided with a tubular fitting 22 through which the seal of the contactor assembly may be checked and the contactor may be evacuated and filled with a controlled atmosphere medium such as an inert gas or the like, after which the fitting 22 is crimped shut and sealed.

Figure 2:
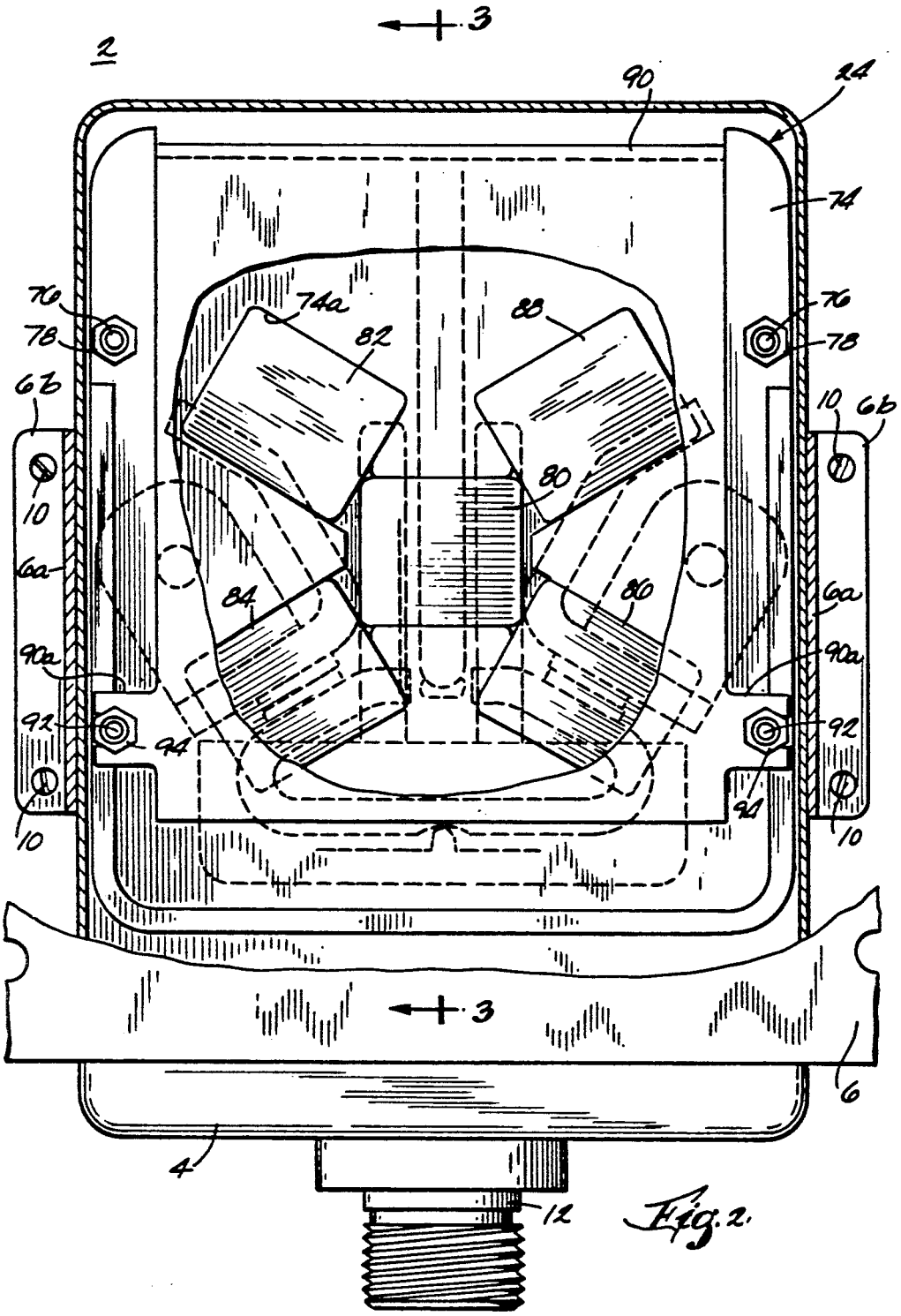
FIG. 2 is a back view of the contactor shown in FIG. 1 with the outer envelope broken away to expose the bi-directional DC switching apparatus of this invention.
Figure 3:
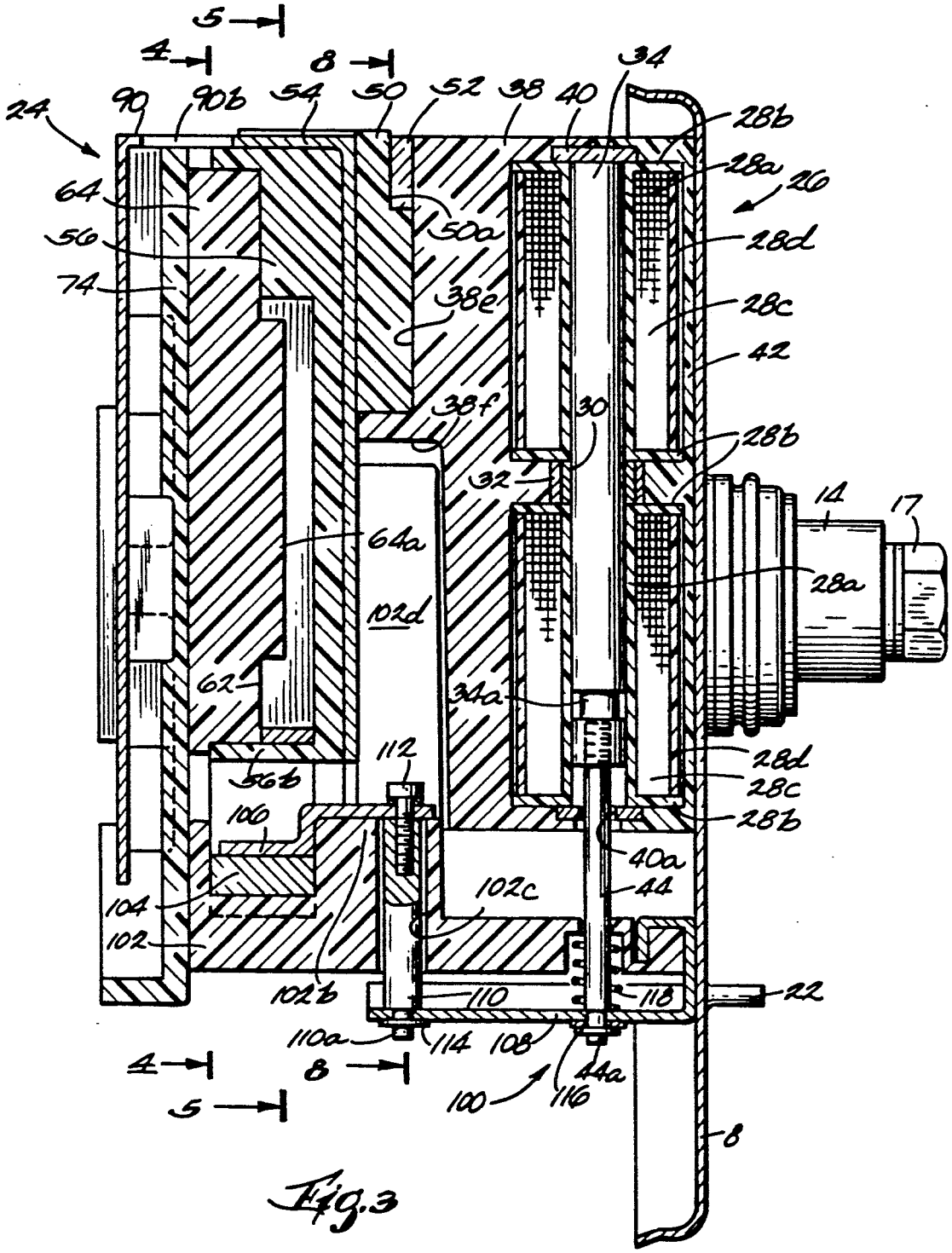
FIG. 3 is a cross section of the contactor of FIGS. 1 and 2 taken generally along the line 3—3 in FIG. 2.
Figure 4:
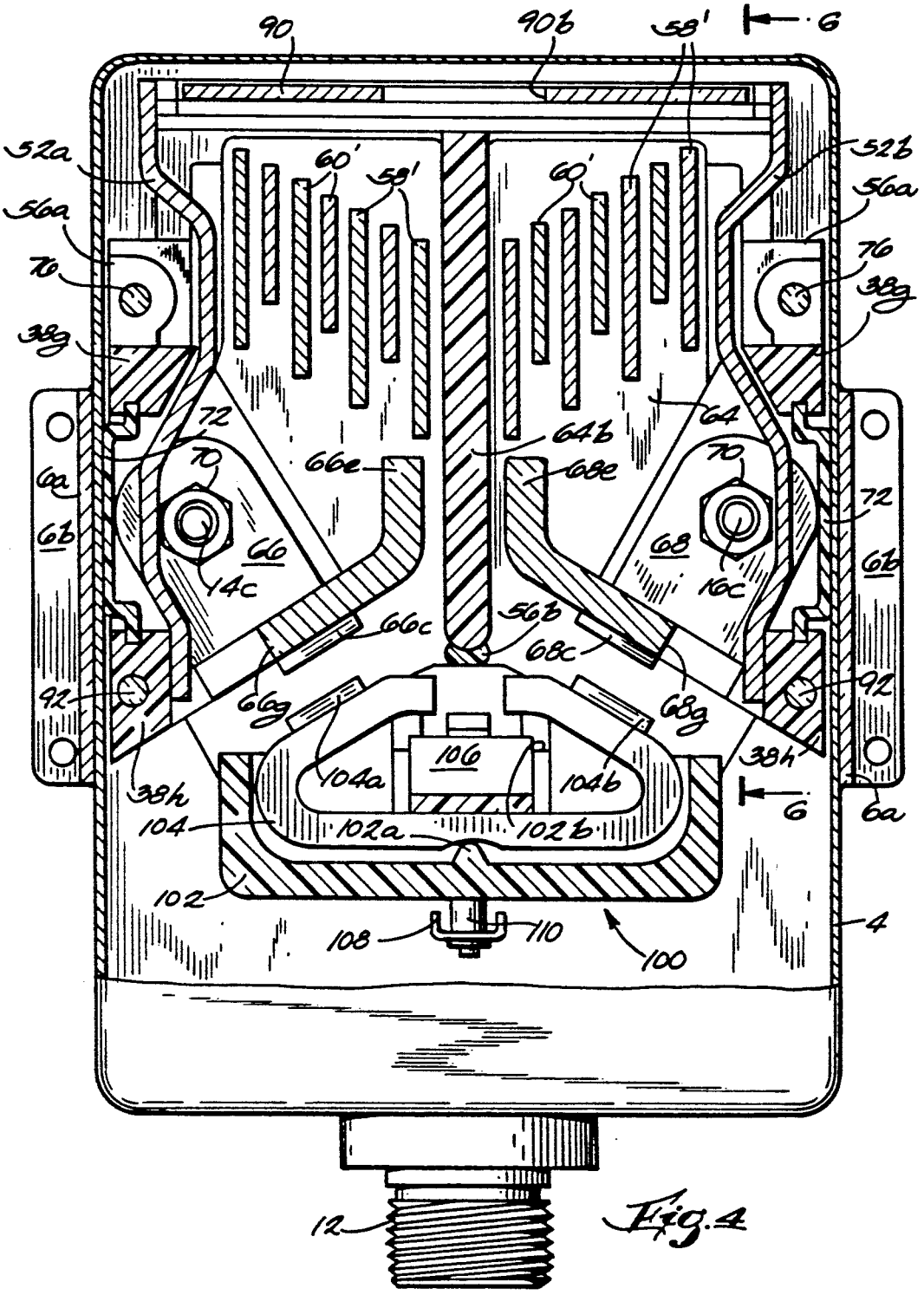
FIG. 4 is a cross section of the contactor taken through rear arc extinguishing chambers of the switching apparatus generally along the line 4—4 in FIG. 3.
Figure 8:
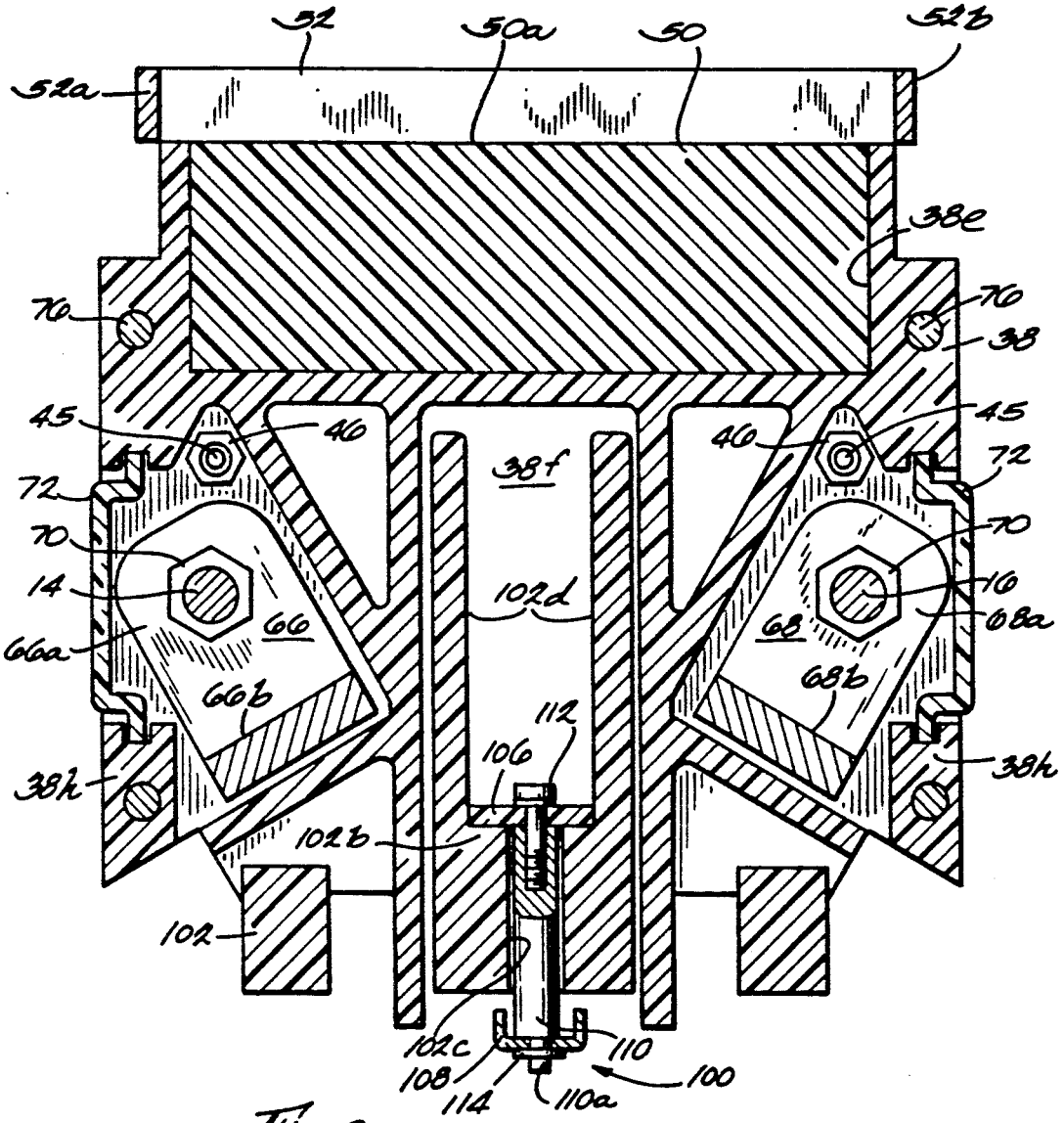
FIG. 8 is a cross section taken along the line 8—8 in FIG. 3 showing a housing member and guideway for a movable contact carrier.
Figure 9:
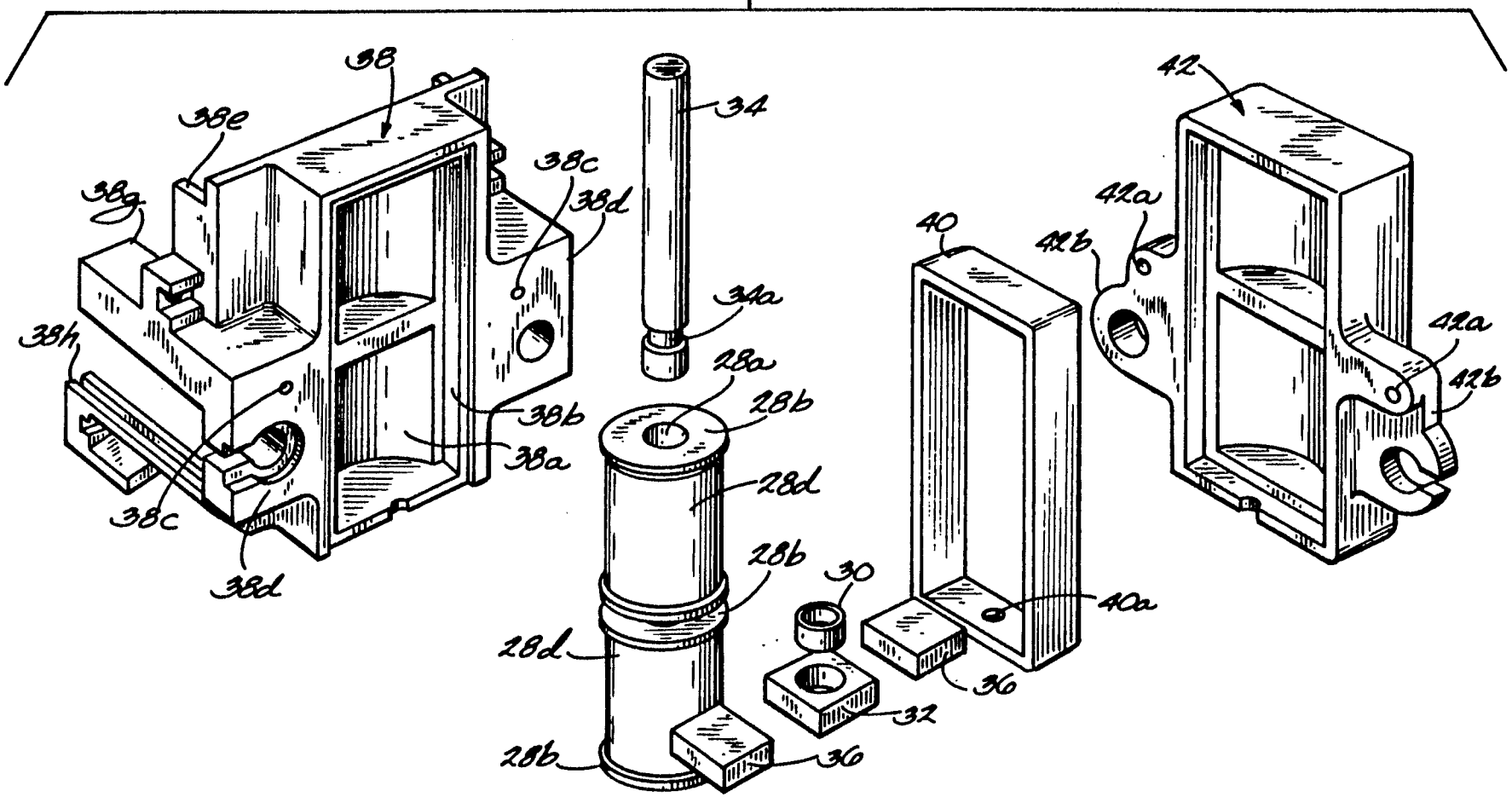
FIG. 9 is an exploded perspective view of an electromagnetically operated linear motor drive means of the switching apparatus of this invention.

Referring to FIGS. 2, 3, 6 and 9, the bi-directional DC switching apparatus represented generally by the reference numeral 24, is built up upon and attached to header 8 prior to joining the external envelope members 4 and 8. The linear motor, represented generally by the reference numeral 26, is first assembled. Referring particularly to FIGS. 3 and 9, motor 26 comprises a pair of identical coils 28 each comprising an insulating bobbin 28*a* having circular flanges 28*b* at opposite ends, a winding 28*c* and an insulating cover 28*d*. Coils 28 are positioned axially end-to-end, separated by a cylindrical brass sleeve disposed within a circular opening in a rectangular magnetic flux guide 32. Sleeve 30 forms a non-magnetic continuance of aligned axial openings in coil bobbins 28*a* for slidably receiving a plunger 34 therein. A pair of rectangular magnets 36 are also disposed between adjacent ends of coils 28 on opposite sides of flux guide 32 in magnetic contact with the flux guide. This assembly is positioned within a cavity 38*a* of an insulating housing 38. Cavity 38*a* (FIG. 9) comprises a pair of generally semi-cylindrical recesses separated by a central web to provide a complemental configuration for the coils 28, magnets 36 and flux guide 32 for accurate positioning and alignment of the coils. Housing 38 is relieved at 38*b* along the periphery of cavity 38*a* to receive a rectangular magnetic frame 40 therein, surrounding the coils, magnets and flux guide assembly. A lower leg of frame 40 has a hole 40*a* which aligns with the axis of coils 28. Housing 38 has a semi-cylindrical recess axially aligned with hole 40*a*, as does a housing cover 42, which also has a cavity complementally configured to position the coils, magnet and flux guide assembly when cover 42 is positioned over the housing 38. A non-magnetic drive rod 44, threadably attached to a lower end of plunger 34, extends outwardly through hole 40*a* and the hole formed by the complemental semicylindrical recesses in housing 38 and cover 42. Cover 42 is attached to housing 38 by suitable fastening means such as screws 45 (FIG. 8) which pass through holes 42*a* and 38*c* (FIG. 9) to receive nuts 46 (FIG. 8).

Figure 6:
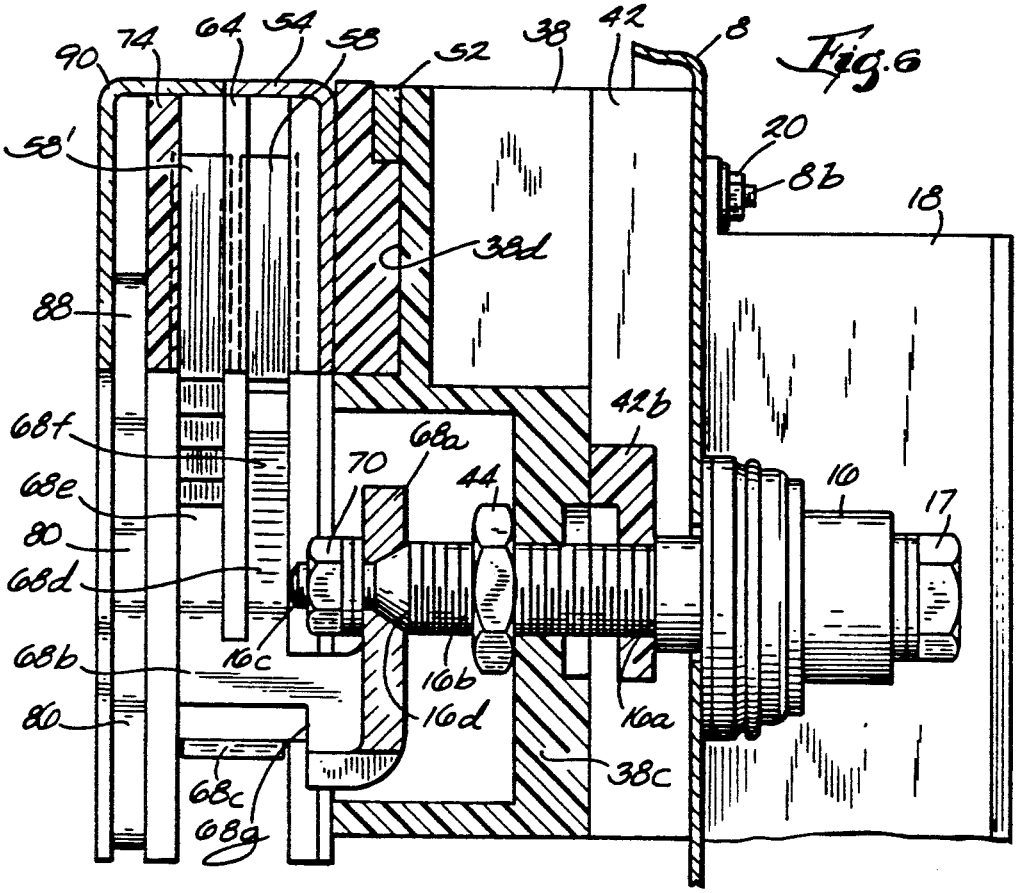
FIG. 6 is a cross section of the bi-directional DC switching apparatus of this invention taken through one of the power terminal poles indicated generally along line 6—6 in FIG. 4.

Housing 38 and cover 42 are provided with laterally extending wings 38*d* and 42*b*, respectively, which have aligned openings therein to be received over the internal ends of power terminals 14 and 16. These terminals are provided with a stepped down annular shoulder such as shown at 16*a* in FIG. 6 against which wing 42*b* abuts. The terminals 14 and 16 are alike and each comprise a threaded body portion such as 16*b* in FIG. 6 which projects through the opening in wing 38*d* to receive a nut 44 thereon to clamp the housing 38 and cover 42 securely to the header 8. The distal ends of terminals 14, 16 have reduced diameter threaded portions 14*c*, 16*c* which are connected to the respective body such as 16*b* by frustoconical transition sections such as 16*d* (FIG. 6).

The rear face of housing 38 is also suitably configured to position additional elements of the switching apparatus of this invention. A rectangular pocket 38*e*, open to the rear surface and upper edge, receives a generally rectangular insulator block 46. The insulator block 46 is notched along an upper edge at 46*a* to cooperatively create, with housing 38, a groove which receives a conductive member 48 which will be described later. A front magnetic plate 54 is positioned against the rear surface of housing 38 and insulator block 46. Although not specifically shown, the profile of magnetic plate 54 complementally conforms to ribs formed on the rear face of housing 38 to position the plate 54 laterally and vertically. Plate 54 overlies a rectangular recess 38*f* (FIGS. 3 and 8), open to the rear surface of housing 38, thereby closing off a rear side of recess 38*f*, leaving it open to the bottom thereof. As will become apparent in later description, the closed recess becomes a part of a guide means for a movable contact carrier of the switching apparatus.

A front insulating cover 56 is next disposed over the magnetic plate 54, similarly positioned laterally and vertically to the housing 38 by complemental formations on the cover 56 and the housing 38. Particularly, cover 56 has a pair of laterally extending rectangular bosses 56*a* which rest upon forwardly projecting arms 38*g* (FIGS. 5 and 9) of housing 38. Cover 56 is provided with a plurality of grooves which receive non-magnetic splitter plates 58 and 60 arranged in angular rows extending upwardly and outwardly from the center of the apparatus. A U-shaped or turn-back center arc splitter plate 62 depends substantially downward from the plates 58 and 60 between the power terminals 14 and 16, resting upon a rearwardly projecting tab 56*b* of cover 56. The splitter plates are made of a non-magnetic material, preferably copper, to provide no influence on magnetic fields directed across the switching apparatus as will be described later. Plates 58 are longer than plates 60 and are arranged alternately with the shorter plates 60 to provide a wider gap between the plates 58 at the lowermost ends thereof than the narrower gaps between the plates 58 and the intermediate plates 60.

An intermediate insulating plate 64, provided with grooves for receiving the splitter plates 58, 60 and 62, is positioned over the splitter plates to receive the plates within the appropriate grooves. As seen best in FIGS. 3 and 5, intermediate plate 64 has a forwardly projecting rib 64*a* which extends into the space between legs of the turn-back splitter plate 62. The rear face of intermediate insulating plate 64 is provided with a rearward extending centrally located rib 64*b* extending over the entire height of the plate, the lower end of rib 64*b* being rounded coincident with the lower end of turn-back splitter plate 62 to rest upon the forwardly projecting tab 56*b*. The rear face of intermediate insulating plate 64 is also provided with grooves for receiving and positioning a second plurality of non-magnetic splitter plates 58′ and 60′ arranged in the same manner as the plates 58 and 60.

Figure 7:
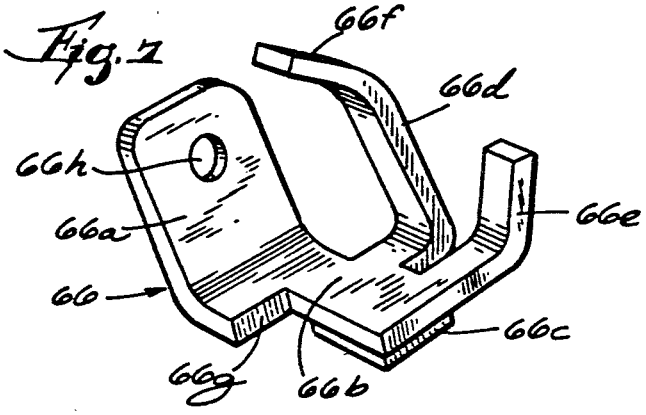
FIG. 7 is a perspective view of a stationary contact of the bi-directional DC switching apparatus of this invention.

At the time of positioning intermediate insulating plate 64 to the assembly, the stationary contacts 66 and 68 are assembled to the power terminals 14 and 16, respectively. The contacts 66 and 68 are a mirror image of each other. Terminal 66 is shown in perspective view in FIG. 7 and only contact 66 will be described in particular detail. The contact is essentially an L-shaped member made of heavy gauge copper or the like having a vertically oriented mounting leg 66*a* and a rearwardly extending leg 66*b* disposed at substantially right angles to the leg 66*a*. A stationary contact element 66*c* is attached to the under side of leg 66*b*. An arc runner projects from the leg 66*b* initially in the plane of leg 66*b*, but at right angles to the rearward extension of that leg. The arc runner is bifurcated into separate arc runners 66*d* and 66*e*. Arc runner 66*d* is substantially longer than arc runner 66*e* and is bent upwardly a slight reverse angle and subsequently further bent at a reverse angle at its distal end 66*f*. The second arc runner extends farther from leg 66*b* before having a single upward bend. Leg 66*b* is notched flush with contact 66*c* at the side opposite the arc runners 66*d* and 66*e*. A mounting hole 66*h* is provided in vertical leg 66*a*, hole 66*h* being counterbored complemental to a frustoconical transition section of terminal 14 corresponding to transition section 16*d*. The stationary contacts 66 and 68 are positioned with intermediate insulating plate 64 such that the arc runners straddle front and rear surfaces of the insulating plate 64. Hex nuts 70 with appropriate washers are threaded onto the ends 14*c*, 16*c* of terminals 14, 16, respectively, to clamp the stationary contacts 66, 68, respectively, to the terminals 14 and 16 by causing the counterbores of holes 66*h* and the corresponding hole of contact 68 to seat firmly against the frustoconical transition section 14*d* and the respective similar section 16*d* on terminal 16.

Previously mentioned conductive member 52 is next assembled to the switching apparatus. Conductive member 52 is essentially an inverted U-shaped member having a flat bight portion which is disposed within the notch 50*a* of rectangular insulating block 50 adjacent housing 38. At the point of lateral emergence from the insulating block 50 and housing 38, the opposite legs of conductive member 52 are bent rearwardly to extend along the sides of housing 38 and front insulating cover 56. The opposite legs 52*a* and 52*b* of conductive member 52 subsequently extend downwardly and are bent laterally inwardly toward each other at a point rearward of the intermediate insulating plate 64 such that the legs 52*a* and 52*b* are essentially aligned with the splitter plates 58′ and 60′ and with the arc runner 66*e* and its corresponding arc runner 68*e* on stationary contact 68. The opposite legs 52*a* and 52*b* extend in a serpentine manner downwardly wherein the distal ends thereof are disposed in proximity to stationary contacts 66 and 68, adjacent the notch 66*g* and corresponding notch 68*g* of stationary contact 68.

A pair of channel shaped insulators 72 are slidingly assembled within slots formed in the under surface of arms 38*g* and the upper surface of a second pair of arms 38*h* spaced downwardly from arms 38*g* of housing 38. A rear insulating cover 74 is then assembled against the splitter plates 58′, 60′ and the central rib 64*b* of intermediate insulating plate 64. The interior or forward face of rear insulating cover 74 is provided with slots for receiving the splitter plates 58′ and 60′. Although not specifically shown, a fiberboard insulator or the like may alternatively be provided with suitable slots to be disposed over the splitter plates 58′ and 60′ at the rear thereof for positioning the same, and the cover plate 74 may be provided with suitable interlocking configuration with the fiberboard insulator to facilitate the assembly thereof. In either construction, the entire assembly of rectangular insulator block 50, conductive member 52, front magnetic plate 54, insulating cover 56, intermediate insulating plate 64, channel shape insulators 72, rear insulating cover 74 and the splitter plates 58, 60, 62, 58′ and 60′, are all held in an assembled relation to the housing 38 by a pair of screws 76 which extend through aligned holes in housing 38, rectangular bosses 56*a* of front cover 56 and in rear cover 74 to receive nuts 78 thereon (FIG. 2).

Referring to FIGS. 2 and 3, the rear face of cover provided with a shallow recess 74*a* which has a four point star appearance. The recess 74*a* positions five permanent magnets 80–88 in the star arrangement as shown in FIG. 2. This arrangement aligns the magnets 84 and 86 with the stationary contacts 66 and 68, magnet 80 with the arc runners 66*e* and 68*e*, and magnets 82 and 88 with the arc runners 66*d* and 68*d*. A rear magnetic plate 90 is positioned over the magnets 80–88 and the insulating cover 74 and is held mechanically thereagainst by screws 92 which extend through aligned holes in housing 38, cover 74 and laterally open slots of tabs 90*a* of plate 90 to receive nuts 94 thereon. The upper ends of magnetic plates 54 and 90 are bent at right angles to project toward each other in alignment therewith such that the adjacent edges of the respective members are in abutting relationship (FIG. 6) to complete a magnetic path around the exterior of the switching apparatus. The top leg of magnetic plate 90 may be provided with a notch 90b (FIG. 3) located centrally to provide a vent opening for arc gasses.

Figure 5:
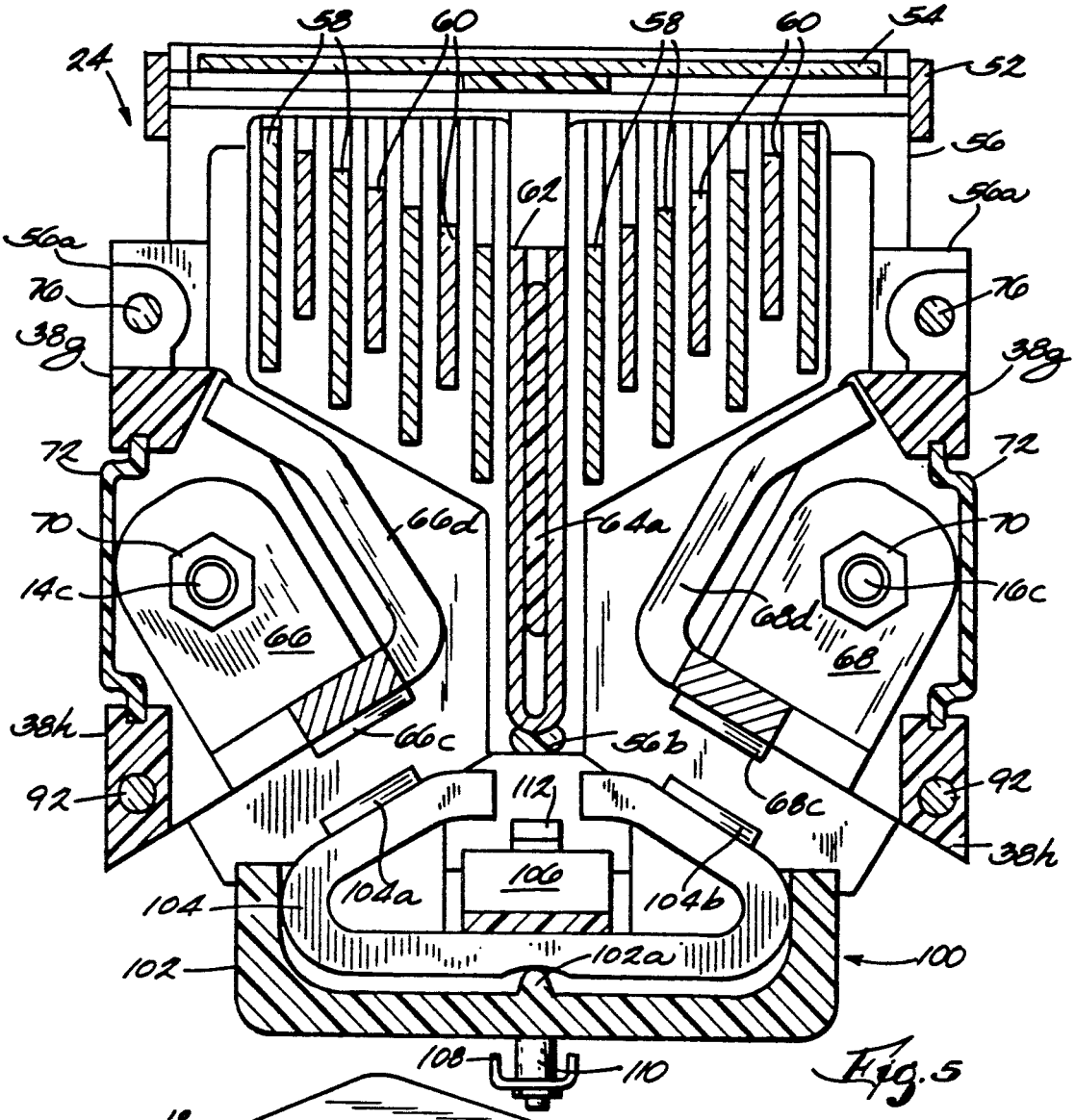
FIG. 5 is a cross section of the bi-directional DC switching apparatus of this invention removed from the outer envelope taken through a front arc extinguishing chamber generally along the line 5—5 in FIG. 3.

The structure resulting from the assembly of elements described above provides a front arc extinguishing chamber as shown in FIG. 5 in which arc runners 66d and 68d diverge upwardly along the lower edges of the splitter plates 58. The turn-back splitter plate 62 depends between the respective stationary contacts to create a first division of any arc formed in the front arc extinguishing chamber. A pair of rear, laterally adjacent arc extinguishing chambers are formed between intermediate insulating plate 64 and rear insulating cover 74. The arc runner 66e and its counterpart 68e on stationary contact 68 extend angularly toward the center of the switching apparatus and subsequently upwardly leading toward the lower edges of the splitter plates 58'. The opposite legs 52a and 52b of conductive member 52 cooperate with the respective arc runners 66e and 68e to form a divergent path from the notch such as 66g of the stationary contacts into the arc chamber. It will be noted that the total width of the front and rear arc chambers plus the intermediate insulator plate 64 is substantially the same as the width of the stationary contact elements 66c and 68c of the stationary contacts 66 and 68. This provides a very compact switching unit, both in front-to-rear dimension and in lateral dimension. The permanent magnets 80–88 are polarized across the width thereof to establish a magnetic field B (FIGS. 10 and 11) directed front-to-rear through the respective arc chambers, the plates 54 and 90 forming a magnetic path around the outside of the switching apparatus and an air gap across the respective arc extinguishing chambers.

A movable contact assembly indicated generally by the reference number 100 is assembled to the switching apparatus 24 and linear motor 26. The movable contact assembly comprises a molded insulating contact carrier 102 to which a movable contact 104 is pivotally mounted upon a fulcrum 102a of the carrier 102. Movable contact 104 is held against fulcrum 102a by a Z-shaped insulating clip 106 which has one leg overlying a shelf portion 102b of carrier 102 and the other leg overlying the movable contact 104. As seen best in FIG. 3, a channel shaped drive link 108 is hooked to the contact carrier 102 at the forward end thereof and extends rearwardly adjacent the lower surface of the contact carrier. Carrier 102 is provided with a hole 102c in the region of shelf 102b through which a pin 110 extends. An upper end of pin 110 is firmly secured in abutting relationship against the under side of the leg of Z-shaped insulating clip 106 that overlies shelf 102b by a screw 112 or other suitable fastener. The lower end of pin 110 is provided with a reduced diameter projection 110a which has an annular groove for receiving a C-clip 114 to firmly attach the pin 110 to the drive link 108. The forward end of drive link 108 is attached to the lower end of drive rod 44 which is provided with a reduced diameter projection 44a similar to projection 110a of pin 110. An annular shoulder formed by rod 44 and reduced diameter projection 44a abuts the upper surface of drive link 108. Projection 44a is provided with an annular groove which receives a C-clip 116 to firmly attach the lower end of drive rod 44 to drive link 108. A helical compression spring 118 is disposed around drive rod 44 between drive link 108 and contact carrier 102, biasing the drive link 108 downwardly away from carrier 102, thereby maintaining clip 106 firmly seated against shelf 102b and against movable contact 104.

The opposite ends of movable contact 104 are reversely bent upwardly and toward each other in planes that are parallel to the orientation of legs 66b and 68b and the initial portions of arc runners 66d and 66e, and to the corresponding portions of stationary contact 68. Movable contact tips 104a are provided on the angularly disposed ends of movable contact 104. Movable contact assembly 100 is disposed for reciprocal linear motion in a vertical direction to bring movable contact elements 104a and 104b into and out of engagement with stationary contact tips 66c and 68c, respectively. Contact carrier 102 is guided for vertical sliding motion by a pair of upstanding legs 102d which are molded integral with the carrier and extend upwardly from the area of shelf 102b. The overall lateral width of the legs 102d is essentially that of the width of recess 38f and the front-to-rear depth of legs 102d is essentially that of the recess 38f when covered by the magnetic plate 54. Moreover, the walls of housing 38 which define the recess 38f depend beyond the lower edge of housing 38 and may be provided with laterally outward extending flanges that cooperate with grooves formed in the carrier 102. With the assembly thus completed of the switching apparatus to the header 8, the can 4 is brought into position over the switching apparatus wherein the open end thereof nests within the flared rear edge of header 8. The juncture of can 4 with header 8 is welded entirely around the periphery to provide a hermetic seal. The flanges 8a and 6b are joined together by the fasteners 10 to provide increased integrity against mechanical damage to the welded joint. The interior of the envelope may be exhausted and filled with an inert gas through tube 22 which is pinched shut and otherwise sealed following completion of the fill process.

The operation of the switching apparatus of this invention will now be described. Power supply conductors may be connected to terminals 14, 16 by screws 17. The polarity of the power supplied to the terminals is immaterial for this switching apparatus. The magnetic field B directed through the respective front and rear arc extinguishing chambers is directed front-to-rear as coming out of the plane of paper when viewing FIGS. 4, 5, 10 and 11. The linear motor 26 is controlled from a remote location through wires connected through multipin connector 12 to the electronics (not shown) of the contactor also housed within the envelope. When an appropriate coil 28 is energized, a magnetic pattern is established within the frame 40 which attracts the plunger 34 against the upper wall of the frame. Once in this position, the permanent magnets 36 establish a holding path that maintains the plunger in this upper position after the energized coil 28 is deenergized. In the upper position of plunger 34, drive rod 44 pulls drive link 108 upwardly which in turn drives contact carrier 102 upwardly by virtue of the resilient connection of spring 118 between drive link 108 and carrier 102. As movable contact elements 104a and 104b engage stationary contact elements 66c and 68c, spring 118 compresses to provide contact closing pressure to the movable contacts As the spring 118 compresses, pin 110 is permitted movement relative to carrier 102 to move the Z-shaped clip 106 upwardly away from movable contact 104, thereby providing no counter forces to the contact.

In a similar manner, a signal is provided to the other coil 28 to establish an opposite flux pattern in the frame 40 whereby the plunger is attracted to the lower leg of frame 40, thereby moving projecting drive rod 44 to an extended position with respect to the motor housing 38 and 42. In so doing, drive rod 44 drives the drive link 108 downwardly which in turn carries with it pin 110 and Z-shaped clip 106 as well as carrier 102 by virtue of the hook at the forward end of drive link 108. This movement effects separation of the movable contact elements 104*a* and 104*b* from the stationary contact elements 66*c* and 68*c*, thereby establishing an electric arc between the stationary and movable contacts.

As seen in FIGS. 3 and 9, plunger 34 has a reduced diameter undercut 34*a* near its lower end. This undercut 34*a* serves as a flux restrictor to reduce the flux and latching strength between plunger 34 and frame 40 at the lower end, thereby permitting coils 28 to be identical and an economic advantage realized thereby. When plunger 34 is magnetically latched in the up position, the contacts are closed, compressing contact pressure spring 118 which applies an unlatching bias to the plunger, assisting the respective coil. Spring 118 provides no assistance when the plunger is magnetically latched in the down position, so the latching strength is reduced accordingly by restricting the flux and reducing the magnetic attractive force. The latter is further reduced by the small surface area surrounding hole 40*a* that is engaged by plunger 34 as compared to the full face of the upper end of plunger 34 which seals against frame 40.

Figure 10:
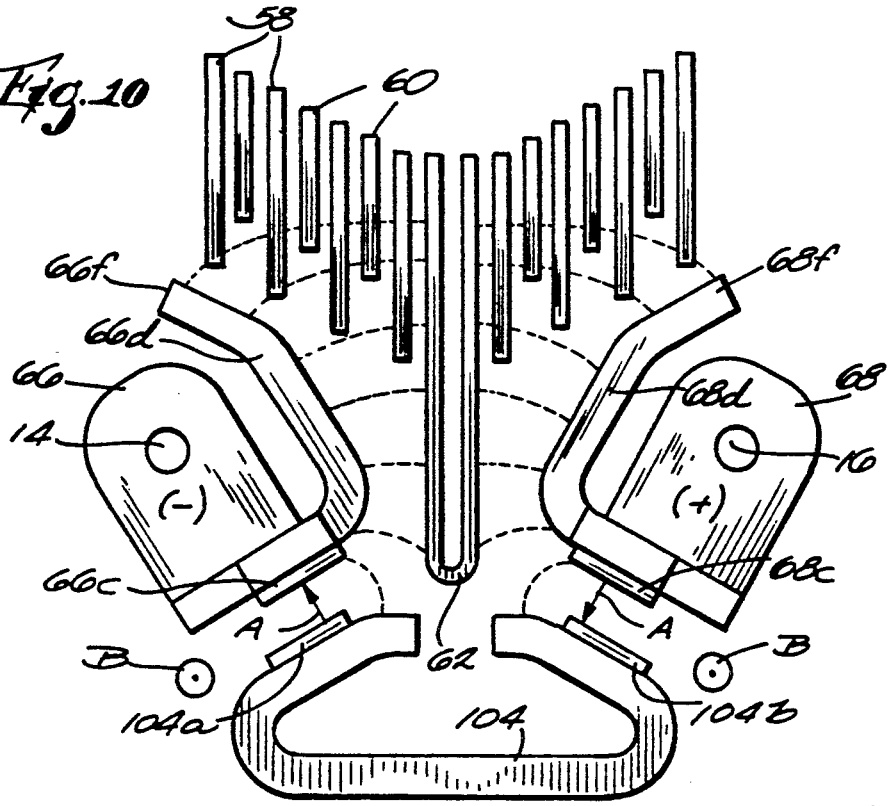
FIG. 10 is a schematic view of the contact structure, arc runners and front arc extinguishing chamber showing arc movement into the chamber.
Figure 11:
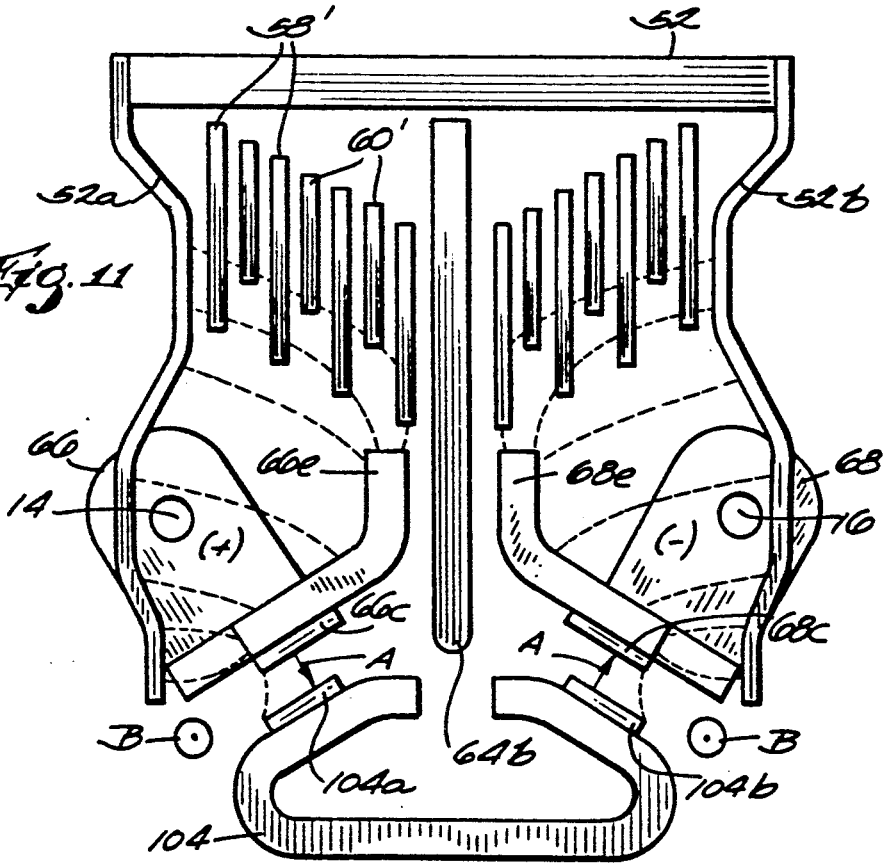
FIG. 11 is a schematic view similar to FIG. 10 showing the contact structure, arc runners and rear arc extinguishing chambers, further showing arc movement into the chambers.

With reference to FIGS. 10 and 11, the polarity of the power supply connected to the switching apparatus will determine whether the forward or rear arc extinguishing chambers will be operational in interrupting the arc. Assuming the positive potential to be connected to terminal 16 and the negative potential to be connected to terminal 14 as shown in FIG. 10, current flowing in the arc will be from stationary contact 68*c* to movable contact 104*a*, through the contact 104 and from the other contact 104*a* into stationary contact 66*c*. With the magnetic field B applied in the front-to-rear direction, i.e. out of the paper, the magnetic field and current direction cooperate to provide forces on the arcs which drive the arcs inwardly toward the center of the switching apparatus. In so doing, the forward arc extinguishing chamber would be operative with the arcs moving along the movable contact, eventually being lead off the respective movable contacts onto the turn-back splitter plate 62, raising the potential of the splitter plate 62 above that of the stationary contact 66. Accordingly, arcs at both contacts 104*a* and 104*b* would be lead off the movable contacts and onto the stationary contact arc runners 68*d* and 66*d*, into the area of divergence between the respective arc runners and the turn-back splitter plate 62. The arcs on both sides of the chamber would ultimately be driven into the wider gaps between splitter plates 58 to separate into a plurality of arcs and arc segments and those segments would ultimately be separated into two additional segments each when the arc moved between the plates 58 and intermediate plates 60, thereby driving the arc voltage up and the arc current down to zero.

If the polarity of the power supply were connected in the reverse manner to the terminals 14 and 16, such as is shown in FIG. 11, then current in the arc will flow from stationary contact 66*c* to movable contact 104*a*, through the movable contact 104, and from the movable contact 104*b* to stationary contact 68*c*. With current directed in this manner and the magnetic field B directed out of the paper, the combined effect of the current and magnetic field establish a force which directs the arc laterally outwardly into the space created by the respective notch 66*g* and 68*g*. The arc moves from the movable contact 66 to the leg 52*a* of conductive member 52 and along the divergent path on the back side of arc runner 66*e* and leg 52*a*, stretching the arc as it enters the wider gaps between the longer splitter plates 58'. The arc then becomes a plurality of separate arcs which subsequently move into the narrower spaces between splitter plates 58' and the intermediate, shorter splitter plates 60' whereby the arc becomes separated into an even greater plurality of separate arc segments, each causing the resistance to rise, driving the current to zero. During this time, the polarity at the opposite leg 52*b* of conductive member 52 becomes positive and the arc drawn at the stationary contact 68*c* moves from movable contact 104*b* to the leg 52*b* and upwardly along that leg and the back surface of arc runner 68*e* to lengthen the arc as it moves upwardly into the splitter plates 58' and subsequently between those plates and intermediate plates 60' to separate the arc into a plurality of short segments, also driving the voltage of the arc upward and the current in the arc to zero. Accordingly, the arc is either extinguished in the front chamber or the rear chamber, according to the polarity of the power supply connection to the switching apparatus. The unique side-by-side arrangement of the arc extinguishing chambers of the rear chamber and the coextensive front-to-rear arrangement between the arc extinguishing chambers and the electromagnetic linear motor provide a particularly compact assembly capable of interrupting DC currents of very large magnitude. The particular electromagnetic motor is easily assembled in a precise alignment with low manufacture costs by providing positioning configurations in molded housings wherein tolerances are readily controlled. Although the contactor of this invention has been disclosed in a preferred embodiment, it is to be understood that it is susceptible of various modifications without departing from the scope of the appended claims.

We claim:

1. Bi-directional direct current switching apparatus comprising:

a spaced pair of conductors connectable to a source of DC power, each conductor having a stationary contact and a bifurcated arc runner leading from said stationary contact converging toward a respective bifurcated arc runner of an other said conductor, said bifurcated arc runners providing corresponding pairs of front and rear arc runners;

a front arc extinguishing chamber having said front arc runners disposed therein, distal ends of said front arc runners being divergent within said front arc extinguishing chamber;

a pair of laterally arrayed rear arc extinguishing chambers each having a respective one of said rear arc runners disposed therein;

conductive means spaced at outboard sides of said spaced pair of conductors within said rear arc extinguishing chambers, said conductive means and respective said rear arc runners diverging from said respective stationary contact into a respective said rear arc extinguishing chamber;

a movable contact;

drive means operable to move said movable contact into and out of bridging engagement with said stationary contacts; and means providing a magnetic field across said front and rear arc extinguishing chambers normal to a direction of movement of said movable contact, said magnetic field and electric current in arcs established between said movable and stationary contacts generating forces which assist movement of said arc in predetermined directions away from said stationary contacts into said front or said rear arc extinguishing chamber according to polarity of said spaced pair of conductors when connected to said source of DC power.

2. The bi-directional direct current switching apparatus as defined in claim 1 wherein the front-to-rear width of a respective front or rear arc extinguishing chamber is substantially one-half a corresponding width of said stationary contact.

3. The bi-directional direct current switching apparatus as defined in claim 1 wherein said conductive means is electrically continuous.

4. The bi-directional direct current switching apparatus as defined in claim 3 wherein said arc extinguishing chambers comprise a plurality of laterally spaced, parallel splitter plates disposed proximate divergent portions of said arc runners and said arc runners and conductive means, said front arc extinguishing chamber comprising an elongated turn-back splitter plate laterally centered and extending between said front arc runners, essentially dividing said front arc extinguishing chamber into two sections.

5. The bi-directional direct current switching apparatus as defined in claim 4 further comprising:

intermediate insulating means disposed between said front and rear arc extinguishing chambers;

a front insulating cover overlying a front face of said front arc extinguishing chamber and said spaced pair of conductors;

a rear insulating cover overlying a rear face of said rear arc extinguishing chamber and said spaced pair of conductors; and said means providing a magnetic field comprises;

a front magnetic plate disposed adjacent said front insulating cover;

a rear magnetic plate disposed adjacent said rear insulating cover;

magnetic means coupling said front and rear magnetic plates; and permanent magnet means disposed adjacent at least one of said magnetic plates.

6. The bi-directional direct current switching apparatus as defined in claim 5 wherein said permanent magnet means is disposed between a respective one of said insulating covers and a respective adjacent magnetic plate.

7. The bi-directional direct current switching apparatus as defined in claim 6 wherein said permanent magnet means is arranged proximate said stationary contacts and proximate diverging ends of respective corresponding said arc runners.

8. The bi-directional direct current switching apparatus as defined in claim 7 wherein said intermediate insulating means extends between said bifurcated arc runners of respective said conductors.

9. The bi-directional direct current switching apparatus as defined in claim 8 wherein said splitter plates are non-magnetic.

10. The bi-directional direct current switching apparatus as defined in claim 5 wherein said drive means comprises an electromagnetically operated linear motor comprising a molded insulating housing, one face of said housing being complementally configured to receive said front magnetic plate and said front cover thereagainst, an axially reciprocally movable plunger movable parallel to said movable contact, and means coupling said movable contact to said plunger comprising a contact carrier having said movable contact mounted thereon, said carrier being guided for linear reciprocal movement, and means resiliently coupling said carrier to said plunger.

11. The bi-directional direct current switching apparatus as defined in claim 10 wherein said carrier comprises guide means elongated in said direction of movement of said movable contact, and said face of said housing comprises complemental means receiving said guide means for guiding movement of said carrier.

12. The bi-directional direct current switching apparatus as defined in claim 11 wherein said complemental means comprises an elongated groove in said face of said housing, said groove being covered by said front magnetic plate defining an open end, and said carrier guide means comprises a pair of upstanding legs slidingly received in said groove from said open end.

13. The bi-directional direct current switching apparatus as defined in claim 10 wherein:

said motor comprises;

a rectangular magnetic frame;

a pair of coils having axial openings disposed axially end-to-end within said frame;

a plunger slidable in said axial opening of said coils between opposed ends of said frame; and said molded insulating housing comprises;

an internal cavity complementally configured to receive and position said frame and said coils.

14. The bi-directional direct current switching apparatus as defined in claim 13 wherein said housing comprises first and second parts separable along a plane parallel to an axis of said coils to expose said cavity for assembly of said frame and said coils therein.

15. The bi-directional direct current switching apparatus as defined in claim 13 wherein one end of said frame has a hole smaller in diameter than said plunger, said housing has a hole aligned with said hole in said frame, and said means coupling said plunger to said contact carrier comprises a non-magnetic pin extending through said holes and attached to said plunger.

16. The bi-directional direct current switching apparatus as defined in claim 13 wherein said motor further comprises permanent magnets disposed between mutually adjacent ends of said coils, said permanent magnets effecting latching of said plunger in respective extreme positions without maintaining a respective coil energized.

17. The bi-directional direct current switching apparatus as defined in claim 16 wherein engaged surface area between said frame and said plunger at said one end of said frame comprises a narrow peripheral area surrounding said hole, said area being less than a corresponding engaged area at an other end of said frame, thereby reducing magnetic latching force at said one end relative to said other end.

18. The bi-directional direct current switching apparatus as defined in claim 17 wherein said movable contacts are held in bridging engagement with said stationary contacts when said plunger engages said other end of said frame, and said means resiliently coupling said carrier to said plunger provides a bias to said plunger counter to said magnetic latching.

19. The bi-directional direct current switching apparatus as defined in claim 18 wherein said plunger has a reduced diameter annular groove proximate said end engagable with said one end of said frame, said groove restricting magnetic flux in said end of said plunger, further reducing magnetic latching strength at said lower end of said frame.

20. The bi-directional direct current switching apparatus as defined in claim 19 wherein said coils are identical, said means resiliently coupling said carrier to said plunger assisting one of said coils in overcoming said magnetic latching strength at said other end of said frame.

* * * * *